United States Patent [19]

Glasser

[11] Patent Number: 4,490,072

[45] Date of Patent: Dec. 25, 1984

[54] DRAINAGE DEVICE

[76] Inventor: Joseph Glasser, 15 Westwood Rd., Storrs, Conn. 06268

[21] Appl. No.: 430,481

[22] Filed: Sep. 30, 1982

[51] Int. Cl.[3] ..... E02B 11/00

[52] U.S. Cl. ..... 405/45; 210/170; 210/459; 405/49

[58] Field of Search ..... 210/170, 163, 459, 486; 405/45, 36, 49

[56] References Cited

U.S. PATENT DOCUMENTS 3,441,140 4/1969 Thuklser ..... 210/170
3,563,038 2/1971 Healy et al. ..... 405/45
3,566,607 3/1971 Sixt ..... 210/459
3,654,765 4/1972 Healy et al. ..... 405/45

*Primary Examiner*—Peter Hruskoci

[57] ABSTRACT

The drainage device includes a stiff plastic core having rigid raised portions and valleys therebetween is oriented vertically and tangentially to a drain pipe which has axially spaced raised annular portions contacting the core and annular recesses with slots to provide passageways for ground water into the pipe. A permeable plastic membrane is warpped around the core and the pipe to prevent fill from filling the passageways so defined.

1 Claim, 2 Drawing Figures

DRAINAGE DEVICE

This invention relates generally to drainage devices of the type for carrying away subsurface water either on a hillside, in the vicinity of foundations or the like, or in filtration systems. More specifically, this invention deals with an improvement over drainage devices of the type which include a drainage pipe provided below a core surrounded by a ground water pervious material to provide a pathway for the water through the core into the drainage pipe.

The primary aim of the present invention is to provide an improved core and pipe assembled with an improved non-woven filter material around both of them such that water is carried downward to the drainage pipe in a very efficient manner.

Figure 1:
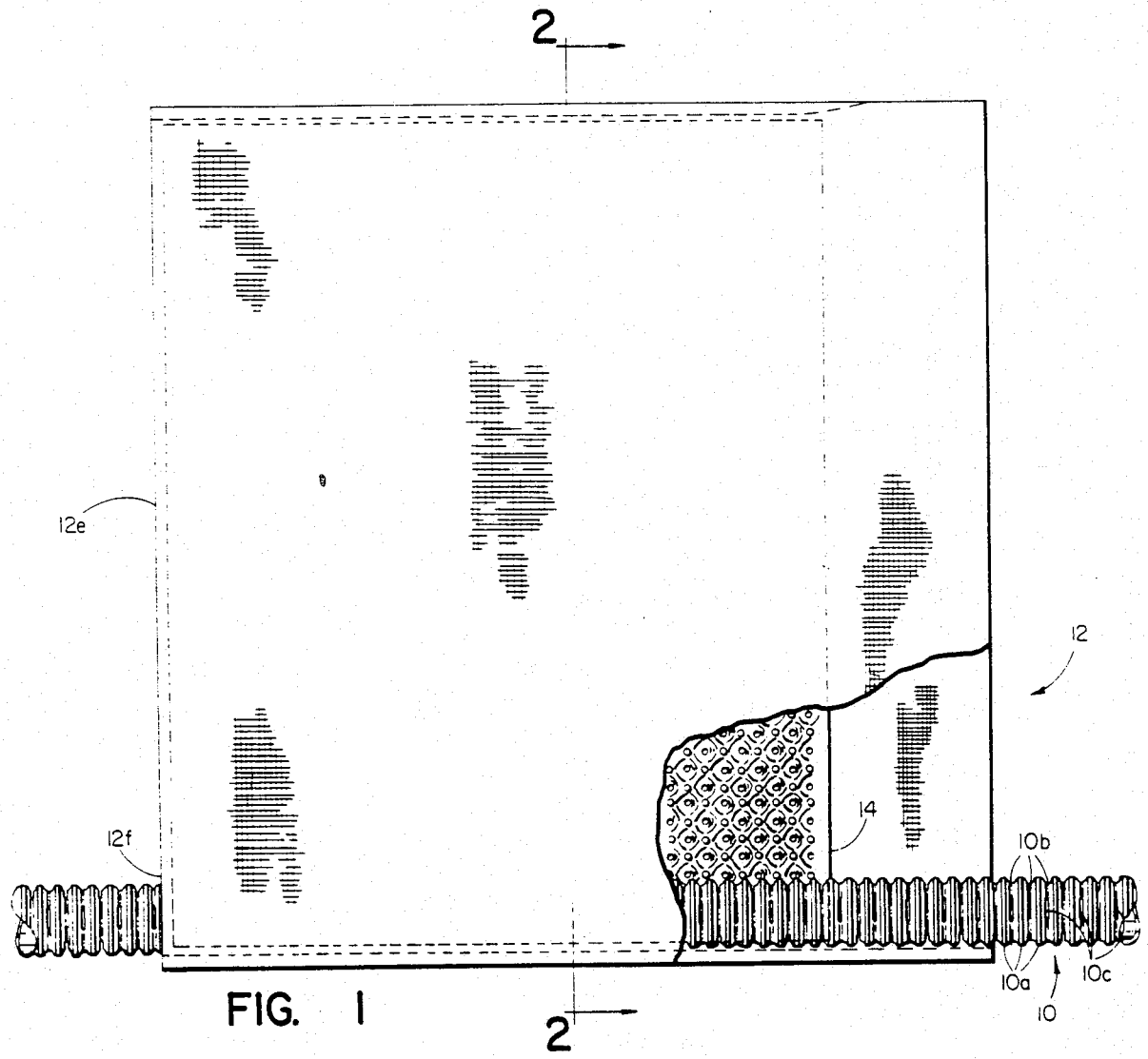
FIG. 1 is a side elevational view of a drainage device constructed in accordance with the present invention with portions broken away to reveal the core and drain pipe within the non-woven envelope material.

Referring to the drawings in greater detail, FIG. 1 shows an elongated drain pipe 10 having axially spaced annular segments 10*a* defining valleys 10*b* therebetween, and with slots 10*c* provided in the sidewall of the pipe, said slots being formed in staggered relationship approximately 90 degrees apart and in diametrically opposed paired relationship to one another so as to preserve the structural integrity of the plastic drain pipe 10 without adversely effecting the drainage characteristics of the pipe itself.

Figure 2:
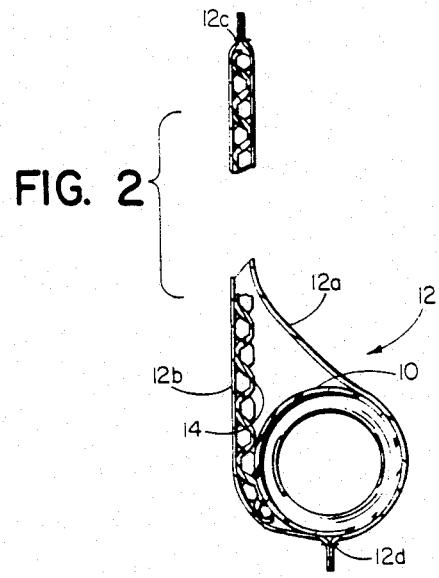
FIG. 2 is a vertical sectional view taken generally on the line 2—2 of FIG. 1.

The pipe 10 extends through a non-woven thermoplastic envelope material indicated generally at 12 which material has opposed faces 12*a* and 12*b* stitched to one another at the top 12*c* and bottom 12*d* to provide an envelope for receiving the pipe 10 as best shown in FIG. 2. The said envelope 12 may be open at its opposite ends, or may instead be folded at one end, as shown for example at 12*e* in FIG. 1, but must of necessity be slit or open at least along a bottom portion thereof as shown at 12*f*, to be capable, conveniently, of receiving the elongated drain pipe 10.

Inside the envelope 12 a core or armature 14 is provided alongside the pipe 10, and is generally tangentially arranged with respect to the pipe 10. This core 14 serves several purposes, namely to provide a separation between the opposed front and back layers 12*a*, 12*b* of the non-woven filter material making up the envelope 12, and to provide a convenient assembly of the filter material 12 with the pipe 10 in order to provide a plurality of passageways for the downwardly flowing ground water to direct this water into the corrugations or valleys defined by the pipe 10 and thence into the slots defined in the pipe so that water can be carried away inside the pipe in a conventional fashion to a catch basin or the like.

The size of the core or armature 14 is preferably equivalent to that of the rectangular space defined between the front and back layers 12*a* and 12*b* of the non-woven filter material 12, but the core may be slightly smaller than the vertical dimension of the envelope and also slightly smaller than the horizontal dimension thereof as suggested in FIG. 1. It will be apparent that several such envelopes and core sheets 12 and 14 respectively can be provided on a single section of pipe 10 in order to fabricate a complete system using drainage devices of the present invention. While it is possible to provide for the overlapping of the envelope 12 in this situation such overlapping is not necessary, and forms no part of the present invention.

The core 14 comprises a plastic sheet which has been formed by passing it between appropriately configured mandrels in a suitable machine (not shown) while the plastic is in a heated condition so that alternate valleys and raised portions are defined in the sheet as suggested in the drawings. The depth of these valleys and raised portions preferably corresponds closely to the depth of the valleys in the drain pipe 10, which dimension is preferably less than $\frac{3}{8}$ of an inch for best results. The valleys and raised lands are spaced from one another in the sheet by a distance of approximately $\frac{3}{4}$ of an inch and the sheet is preferably formed from a stiff plastic material such as polystyrene having a thickness of between 15 and 45 mils, preferably on the order of 1/32 of an inch in thickness.

As so constructed the drainage device of the present invention is well adapted to handle the downward flow of water beneath the surface of a ground in a drainage system or a septic system filter such that normal hydrostatic pressure will force this water inwardly through the water permeable filter material 12 and into the valleys defined in the core 14 where gravity carries the water downwardly to the drainage pipe and more particularly to the slotted openings in the drainage pipe 10 as described above.

I claim:

1. A drainage device comprising an elongated drain pipe defining axially spaced radially outwardly extending portions which provide annular valleys therebetween, said valleys communicating with openings defined in the sidewall of the pipe to provide passageways for water to pass into the interior thereof, a generally rectangular plastic core sheet having opposing sides with alternate raised land portions and surrounding valleys, of corresponding configuration, said sheet arranged tangentially to the pipe so that said land portions contact the raised annular portions of the pipe and are separated from the said valleys in said pipe, said sheet being impervious to ground water but defining a plurality of passageways around the raised land portions thereof for water to flow through said surrounding valleys along its external surface and direct said water into the valleys of said pipe, and a non-woven plastic sheet material pervious to water and wrapped around both the core sheet and the pipe so as to prevent the surrounding fill material from plugging the passageways defined by the core sheet and the valleys defined by the pipe when the drainage device is installed in a subterranean system for draining ground water from the surrounding fill.

* * * * *